United States Patent [19]

Wasserman

[11] Patent Number: 4,697,407

[45] Date of Patent: Oct. 6, 1987

[54] RETROREFLECTIVE FIBER AND METHOD OF MAKING SAME

[75] Inventor: Allan Wasserman, Lincoln, R.I.

[73] Assignee: Minnesota Mining and Manufacturing Company, St. Paul, Minn.

[21] Appl. No.: 795,738

[22] Filed: Nov. 6, 1985

Related U.S. Application Data

[60] Continuation of Ser. No. 565,753, Dec. 27, 1983, abandoned, which is a continuation of Ser. No. 346,942, Feb. 8, 1982, abandoned, which is a division of Ser. No. 133,281, Mar. 24, 1980, Pat. No. 4,336,092.

[51] Int. Cl.[4] ..... D02G 3/00

[52] U.S. Cl. ..... 57/238; 57/259; 57/260; 428/372; 428/379; 428/389; 428/395; 428/397; 428/401

[58] Field of Search ..... 428/372, 373, 375, 378, 428/379, 389, 390, 395, 397, 401; 57/243, 244, 248, 249, 905, 238, 259, 260

[56] References Cited

U.S. PATENT DOCUMENTS

| | | | |
|---|---|---|---|
| 2,567,233 | 9/1951 | Palmquist et al. . | |
| 2,714,569 | 8/1955 | Prindle et al. . | |
| 2,737,668 | 5/1960 | Carey, Jr. et al. . | |
| 2,974,055 | 3/1961 | Scharf . | |
| 3,050,824 | 8/1962 | Lemelson . | |
| 3,172,942 | 3/1965 | Berg . | |
| 3,361,616 | 3/1965 | Scharf . | |
| 3,528,877 | 9/1970 | Scharf . | |
| 3,802,944 | 4/1974 | Tung | 428/143 |

*Primary Examiner*—Lorraine T. Kendell

*Attorney, Agent, or Firm*—Donald M. Sell; James A. Smith; William B. Barte

[57] ABSTRACT

A thread-like continuous retroreflective fiber and method of making same, comprising the steps of laminating a thin film of retroreflective material to a supporting polyester film, and then slitting the laminate to form narrow strips of retroreflective material having sufficient strength to be combined with other fibers to form a composite yarn having retroreflective characteristics, which composite yarn may then be woven, knitted, or spun to provide a fabric having retroreflective characteristics.

3 Claims, 4 Drawing Figures

RETROREFLECTIVE FIBER AND METHOD OF MAKING SAME

This is a continuation of application Ser. No. 565,753, filed Dec. 27, 1983, and now abandoned, which is a continuation of application Ser. No. 346,942, filed Feb. 8, 1982, and now abandoned, which is a division of application Ser. No. 133,281, filed Mar. 24, 1980, now U.S. Pat. No. 4,336,092.

BACKGROUND AND SUMMARY OF THE INVENTION

By definition a retroreflective material is a material which when engaged by a beam of light will reflect the light directly back to the location of the light source. Such a material is commonly used in roadways and aircraft runways to define the outer edges and/or center line of the roadway so that when engaged by headlights of a vehicle at night, the operator of the vehicle will be able to visually perceive and determine the roadway edges and/or center line.

Retroreflective material is also marketed in the form of a thin film, usually with an adhesive backing on one surface thereof, whereby the retroreflective film may be adhered to a person's clothing for safety purposes, i.e. to make that person more readily discernible at night by the headlights of approaching vehicles, or for securing to any other surface where retroreflective characteristics are desired, such as roadsigns, etc. U.S. Pat. No. 3,849,804 dated Nov. 26, 1974; U.S. Pat. No. 3,276,416 dated Oct. 4, 1966; and U.S. Pat. No. 3,499,416 dated Mar. 10, 1970, are representative of prior art patents that suggest the attachment of light reflecting material to clothing, automobilles, safety belts, etc., although it is not clear whether the reflective material used in these patents is usually retroreflective material.

In any event, there are numerous disadvantages to having to secure a light reflecting film to fabric material, and specifically, a problem exists in effecting a secure attachment of the film to the fabric because of the flexibility of the latter, there is always the danger that the film will inadvertently become detached, and additionally one must necessarily suffer the expense and inconvenience of separately purchasing the light reflective film, and then going through the steps of cutting the reflective film to the desired size or configuration and then attaching it to the fabric or garment, etc.

It therefore would be highly desirable to provide a yarn which includes as a part thereof retroreflective fibers so that when said yarn is woven, knitted or spun to provide a finished fabric and/or garment, the latter will inherently have retroreflective characteristics. Such garments would have obvious utility for persons who jog in the nighttime, policemen on traffic duty in heavily congested areas at nighttime, etc. The problem, however, is that the retroreflective film presently being marketed does not have sufficient body or strength so as to be effectively handled if cut or slit into the form of elongated strands of fibers. Specifically, the elasticity of the material as well as the inherent weakness thereof preclude effective use of such strands, even as part of a composite yarn, for conventional weaving, knitting, spinning, etc.

It is therefore the primary object of the present invention to provide a method of making a continuous thread-like fiber of retroreflective material which nevertheless has sufficient strength and body so that it may be effectively combined with other fibers to provide a composite yarn which has retroreflective characteristics, which composite yarn may then be conventionally woven, knitted or spun to provide a fabric or garment having retroreflective characteristics. The present invention achieves this objective by laminating the thin film of retroreflective material to an even thinner polyester supporting film, the polyester supporting film adding sufficient strength and body to the laminate so that the latter may be effectively slit or cut to form elongated thread-like strands or fibers of, ribbon-like substantially rectangular cross-section configuration having retroreflective characteristics.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
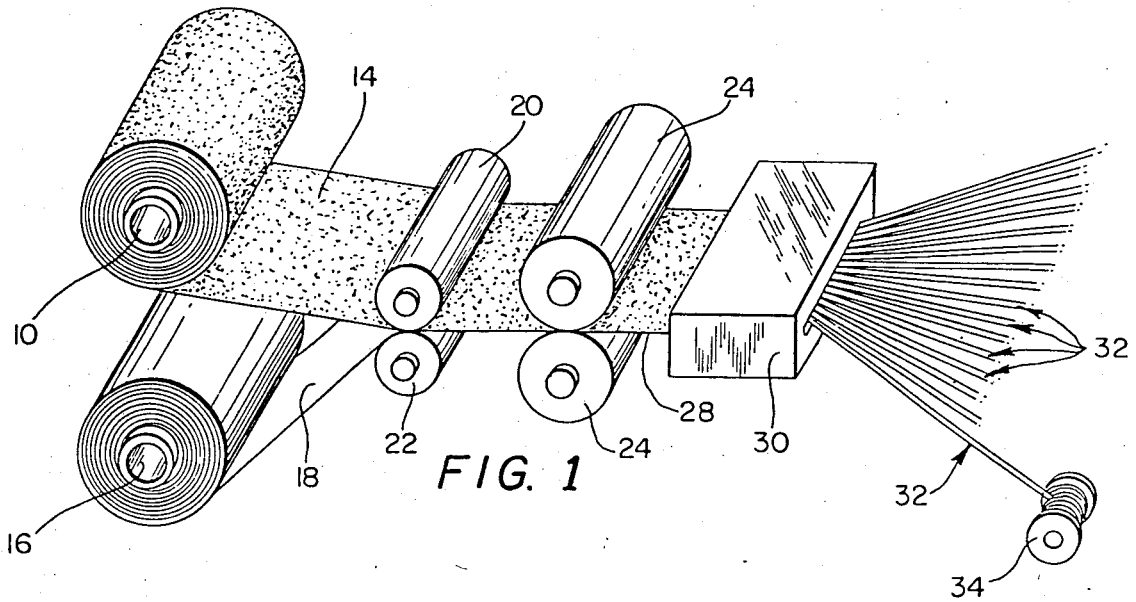
FIG. 1 is a schematic perspective view illustrating the process for forming the thread-like retroreflective fiber of the present invention.
Figure 2:
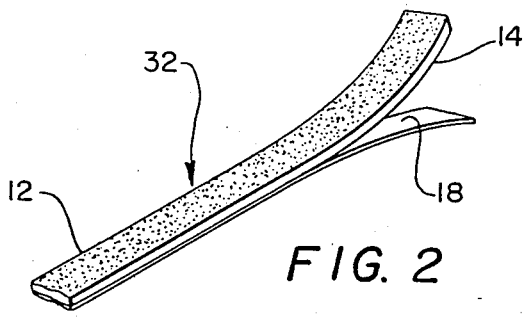
FIG. 2 is a fragmentary. perspective view, on a greatly enlarged scale, showing the retroreflective fiber per se.

Referring now to the drawing, and more particularly to FIG. 1, a first roller 10 carries and feeds a supply of a thin retroreflective fillm 12, such as the retroreflective film presently being marketed by the 3M Company and identified as #8710 Scotchlite brand transfer film. Specifically, #8710 Scotchlite film consists of a plurality of exposed minute glass beads or lenses bonded in a flexible elastomeric material. The retroreflective film 12 preferably has a thickness of approximately 5 mils and is provided with an adhesive, either of the pressure or heat sensitive type, on surface 14 thereof. A similar roller 16 carries and feeds a thin polyester film 18, such as Mylar (Dupont trademark), the thickness of which is preferably in the range of ½ mil. As will be noted, the film 18, which is of the same width as the film 12 and is aligned therewith, is brought into intimate contact with adhesive surface 14 of the retroreflective film 12 by rollers 20, 22 and then the two layers of film are passed between pressure rollers 24, 26 which firmly adhere the supporting film 18 to the retroreflective film 12. It will be understood that if heat is required to effect the desired securement of film 18 to the film 12, then the rollers 24, 26 may be heated rollers. The now laminated film 28 then passes to any conventional slitting or cutting apparatus 30 which apparatus slits or cuts the laminated film 28 into thin strands or fibers 32 which are then received and stored on spools 34. The width of the strands or fibers 32 may vary but will normally be somewhere in the range of 1/16 of an inch to 1/100 of an inch.

In order to enhance the reflective characteristics of the strand or fiber 32, as well as the aesthetics thereof, the supporting film 18 may be metallized on one or both of its surfaces. If metallized on only one surface, then obviously the non-metallized surface is the surface that would be adhered to surface 14 of retroreflective film 12.

It would be understood that the retroreflective film 12 is frequently marketed with carrier and/or release films on opposite sides thereof. In this connection the apparatus shown in FIG. 1 may also comprise means (not shown) for automatically separating and removing the carrier and/or release films from the retroreflective material 12 prior to the lamination of such material to the supporting polyester film 18.

Figure 3:
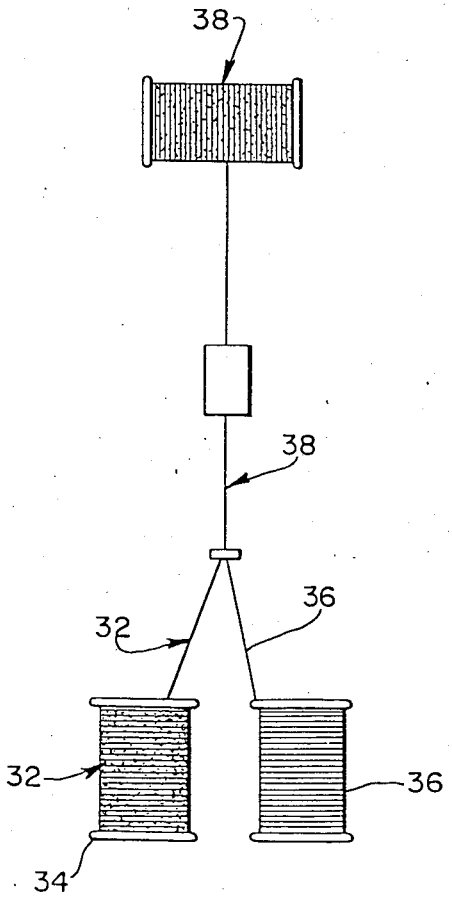
FIG. 3 is a schematic view of apparatus for combining a retroreflective fiber of the present invention with another fiber for providing a composite yarn having retroreflective characteristics.
Figure 4:
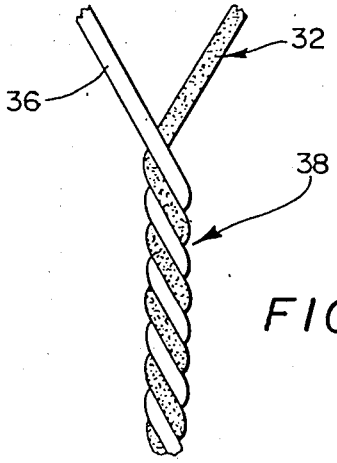
FIG. 4 is a fragmentary enlarged view of the yarn per se produced by the apparatus of FIG. 3.

It will be understood that the supporting polyester film 18 provides sufficient body and strength to the laminated strand or fiber 32 so that the latter may effectively be used in the weaving, knitting, or spinning of fabrics. Although it is conceivable that a fabric could be made entirely of the retroreflective strands 32, the preferable procedure is to combine the retroreflective strand with any other textile strand, either synthetic or nonsynthetic, in order to provide a composite yarn having retroreflective characteristics. FIG. 3 illustrates the continuous retroreflective fiber 32 being twisted or otherwise combined with another nonreflective fiber 36 to provide a composite yarn 38 shown in detail in FIG. 4. It should also be noted that the retroreflective strand or fiber 32 constructed in accordance with the present invention may be utilized in the same apparatus and method disclosed and described in my U.S. Pat. No. 3,382,655 dated May 14, 1968. Specifically, the exact same apparatus and method would be employed, except that instead of utilizing the metallic yarn 17 in my aforesaid patent, the retroreflective yarn 32 would be substituted in place thereof. In either case, the resultant yarn would have sufficient retroreflective fibers therein so as to achieve the desired retroreflective characteristics. The composite yarn would then be used to produce any desired fabric or article of apparel, such as by conventional weaving, knittig or spinning techniques, and the end product would likewise possess, as an integral and inherent part thereof, the desired retroreflective characteristics.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A retroreflective thread-like fiber consisting of:

(a) a first elongated ribbon-like strand having a substantially rectangular cross-section a thickness of approximately five mils and a width in the range between 10 and 62.5 mils and having a plurality of exposed minute glass beads bonded in a flexible elastomeric material on one surface of said strand; and (b) a second elongated ribbon-like strand having a substantially rectangular cross-section and formed of supporting material adhered to the opposite surface of said first strand, said second strand being approximately one-tenth as thick and the same width as said first strand whereby a composite ribbon-like fiber having a substantially rectangular cross-section is formed having said exposed beads on one surface only.

2. The fiber of claim 1 further characterized in that said supporting material is a polyester, and at least the exposed surface of said second strand is metallized.

3. A composite yarn comprising the retroreflective fiber of claim 1 in twisted relation with a second nonretroreflective fiber.

* * * * *